US007267408B2

(12) United States Patent
Xiang

(10) Patent No.: US 7,267,408 B2
(45) Date of Patent: Sep. 11, 2007

(54) ARTICLE OF RATTAN FURNITURE HAVING A SEAT SUPPORT CUSHION

(75) Inventor: Guangqiang Xiang, Linhai (CN)

(73) Assignee: Zhejiang Yongqiang Group Co., Ltd., Linhai, Zhejiang Province (CN)

( * ) Notice: Subject to any disclaimer, the term of this patent is extended or adjusted under 35 U.S.C. 154(b) by 0 days.

(21) Appl. No.: 11/419,293

(22) Filed: May 19, 2006

(65) Prior Publication Data

US 2007/0018495 A1 Jan. 25, 2007

(51) Int. Cl.
*A47C 7/02* (2006.01)
*B27J 7/00* (2006.01)

(52) U.S. Cl. ..... 297/452.59; 297/451.9; 297/452.64; 144/333

(58) Field of Classification Search ..... 144/333; 297/451.9, 446.2, 218.4, 452.63, 452.64, 297/452.55, 452.56, 452.59; 29/91.1, 428
See application file for complete search history.

(56) References Cited

U.S. PATENT DOCUMENTS 2,354,436 A * 7/1944 Stedman ..... 297/452.64
3,298,743 A * 1/1967 Albinson et al. ..... 297/451.4
3,300,251 A * 1/1967 Helms ..... 297/451.4
3,713,697 A 1/1973 Koepke
4,295,235 A 10/1981 Deitz
4,465,534 A 8/1984 Zelkowitz
4,577,907 A 3/1986 Talmon et al.
4,586,751 A * 5/1986 McGuire ..... 297/451.9
4,685,738 A * 8/1987 Tinus ..... 297/452.56
4,743,323 A * 5/1988 Hettinga ..... 156/160
5,405,179 A * 4/1995 Jih ..... 297/452.49
5,474,362 A 12/1995 Albecker, III
5,788,332 A * 8/1998 Hettinga ..... 297/452.55
6,827,402 B2 12/2004 Habermann et al.
2005/0104423 A1 5/2005 Yu

* cited by examiner

*Primary Examiner*—Milton Nelson, Jr.
(74) *Attorney, Agent, or Firm*—Alston & Bird LLP

(57) ABSTRACT

An improved support area for use with rattan furniture. The present invention provides a frame, a seat contact portion, and a back contact portion. In various embodiments, the chair includes a seat cushion that is supported by a seat support portion of the frame. The seat cushion is covered on its outside by a rattan outer layer that is attached to the seat support structure such that the rattan outer layer conforms to the shape of the seat cushion and the presence of the seat cushion is obscured by the rattan outer layer. In other embodiments, the back support portion may include a similarly configured back cushion. As a result, the present invention has the appearance and aesthetic appeal of a typical article of rattan furniture, having rattan seat and back surfaces, however the present invention provides a level of comfort that is not typically provided by rattan seat and/or back surfaces.

11 Claims, 1 Drawing Sheet

ARTICLE OF RATTAN FURNITURE HAVING A SEAT SUPPORT CUSHION

BACKGROUND OF THE INVENTION

1) Field of the Invention

Figure 1:
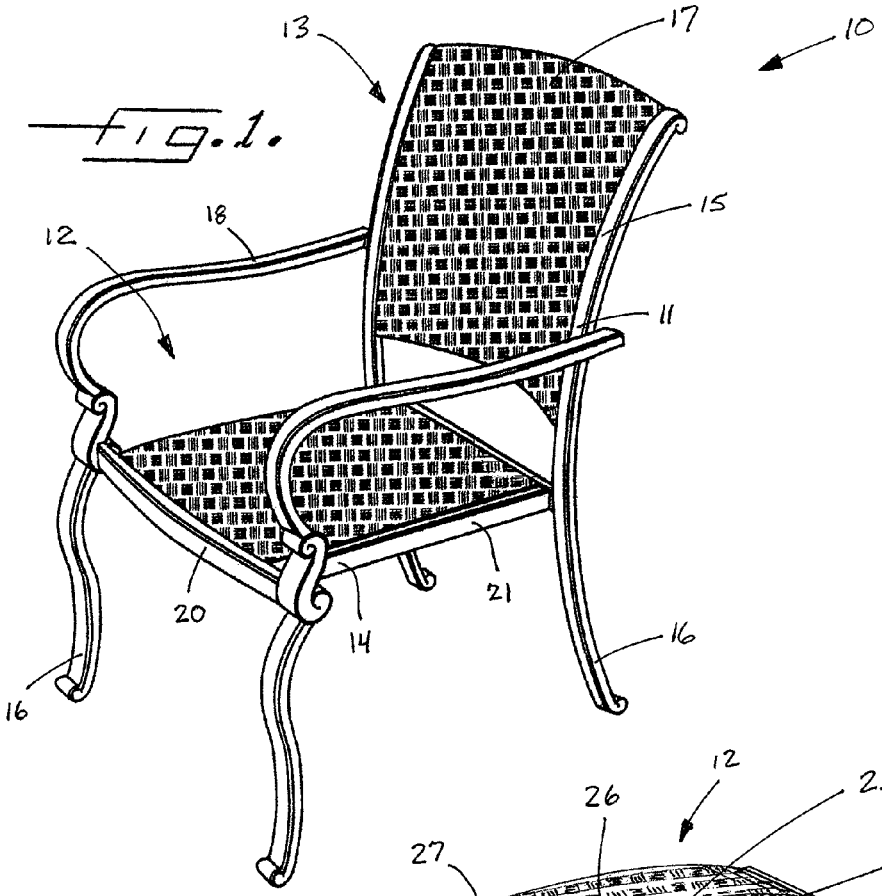

The present invention relates to furniture in general, and more particularly to furniture that utilizes seating surfaces made out of natural or synthetic rattan materials.

2) Description of Related Art

There are various characteristics that are important in the design and manufacture of furniture. For example, many articles of furniture, aside from purely decorative articles, are designed to bear a certain load, for example, the weight of a person sitting in a chair or the weight of articles supported by a bookshelf. As such, manufacturers chose structures and materials that are designed to achieve a certain level of performance. However, this performance must be balanced with other practical considerations, such as aesthetic appeal, comfort, cost, and durability.

In order to produce an article of furniture that creates a desired balance between these characteristics, many furniture manufacturers experiment with the use of different materials. One of the common materials used in the production of furniture is rattan. Rattan refers to a lightweight, tough fiber obtained in strips from the stem of a plant that can be woven together. Rattan is light, durable, and relatively strong, and can be painted or stained like hardwoods. Many furniture manufacturers use rattan to create chairs, couches, dressers, and other pieces of furniture. The strength, durability, and light weight of rattan makes it ideal for inexpensive casual furniture applications. As a result, rattan is often chosen for outdoor furniture such as patio chairs and couches.

In a continuing effort to decrease costs, some furniture manufacturers use synthetic materials to imitate the light, durable, and strong performance of rattan furniture. Because certain consumers prefer the look of woven furniture, some of these manufacturers produce furniture articles that have the appearance of natural fibers, but are actually woven strips of synthetic material. These materials are often referred to as synthetic rattan materials. For the purposes of the current specification and appended claims, the term "rattan" will be used to refer to both natural and synthetic rattan materials.

Because of cost considerations and the strength of a web of rattan material, a typical rattan chair uses a single web of woven material to produce the support portions (the seating and back surfaces). However, these portions can be very firm and thus the aesthetical appeal of rattan seating and back surfaces may be compromised by a lack of comfort. To accommodate these concerns, some furniture manufacturers include a decorative cushion that may be placed on top of the support portions. However, some consumers complain that the cushions obscure the aesthetic appeal of the rattan surfaces.

Therefore, there is a need for an improved support portion for use with rattan furniture. The support portion should provide improved comfort, while maintaining the aesthetical appeal of the rattan furniture. The improved support portion should be simple and cost effective.

BRIEF SUMMARY OF THE INVENTION

The present invention achieves the above objectives and others by providing an improved support portion for use with rattan furniture. The support portion includes a cushion that is covered by a rattan layer such that the presence of the cushion is obscured. As a result, the present invention provides articles of rattan furniture that include more comfortable support portions. By including a cushion underneath the rattan layer, the present invention provides a simple and cost-effective solution for improving the comfort of an article of rattan furniture, while maintaining the aesthetic appeal of rattan surfaces.

In one embodiment, the present invention provides an article of rattan furniture comprising a frame, a back contact portion, and a seat contact portion. The frame comprises a seat support structure, a back support structure, and four legs supporting the seat and back support structures. The seat support structure is in an approximate horizontal orientation and has a front cross member, a rear cross member, a pair of lateral cross members rigidly attached to the front and rear cross members, and a support surface rigidly attached to and extending between at least two of the cross members. The back support structure is in a vertical or slightly reclined orientation and extends adjacent the rear cross member of the seat support structure. The back contact portion comprises a first rattan outer layer coupled to the back support structure. The seat contact portion is coupled to the seat support structure and comprises a seat cushion supported by the support surface and located between the front cross member, the rear cross member, and the lateral cross members, and a second rattan outer layer located on the outside of said seat cushion and attached to said seat support structure. The second rattan outer layer covers the seat cushion such that the second rattan outer layer conforms to the shape of the seat cushion and the presence of the seat cushion is obscured by the second rattan outer layer. In one embodiment, the frame may be made of a metal material. In another embodiment, the seat cushion may be made of a foam material. Another embodiment further comprises a cushion cover layer substantially surrounding the seat cushion, wherein the second rattan outer layer covers the cushion cover layer and the seat cushion, such that the presence of the seat cushion and the cushion cover layer is obscured by the second rattan outer layer. In another embodiment, the back contact portion further comprises a back cushion supported by the back support structure, wherein the first rattan outer layer covers the back cushion such that the first rattan outer layer conforms to the shape of the back cushion and the presence of the back cushion is obscured by the first rattan outer layer. Another embodiment further comprises a cushion cover layer substantially surrounding the back cushion, wherein the first rattan outer layer covers the cushion cover layer and the back cushion such that the presence of the back cushion and the cushion cover layer is obscured by the rattan outer layer.

In yet another embodiment, a method of constructing a rattan furniture article is presented. The method comprises forming a frame element to provide structural support for the furniture article, the frame element having a seat support structure in an approximate horizontal orientation and back support structure in a vertical or slightly reclined orientation, and four legs supporting the seat support structure and the back support structure. The method further comprises providing a back support portion comprising a first rattan outer layer coupled to the back support structure, providing a seat cushion supported by the seat support structure, and securing a second rattan outer layer to the seat support structure and on the outside the seat cushion to create a seat contact portion, wherein the second rattan outer layer conforms to the shape of the seat cushion and the presence of the seat cushion is obscured by the second rattan outer layer. In another embodiment, the step of providing a seat cushion further comprises providing a cushion cover layer that surrounds the seat cushion. In another embodiment, the step of providing a back contact portion further comprises the steps of providing a back contact portion comprising a back cushion supported by the back support structure, and securing the first rattan outer layer to the back support structure on the outside of the back cushion to create a back contact portion, wherein the first rattan outer layer conforms to the shape of the back cushion and the presence of the back cushion is obscured by the first rattan outer layer. In another embodiment, the step of providing a back cushion further comprises providing a cushion cover layer that surrounds the back cushion.

BRIEF DESCRIPTION OF THE SEVERAL VIEWS OF THE DRAWING(S)

Figure 2:
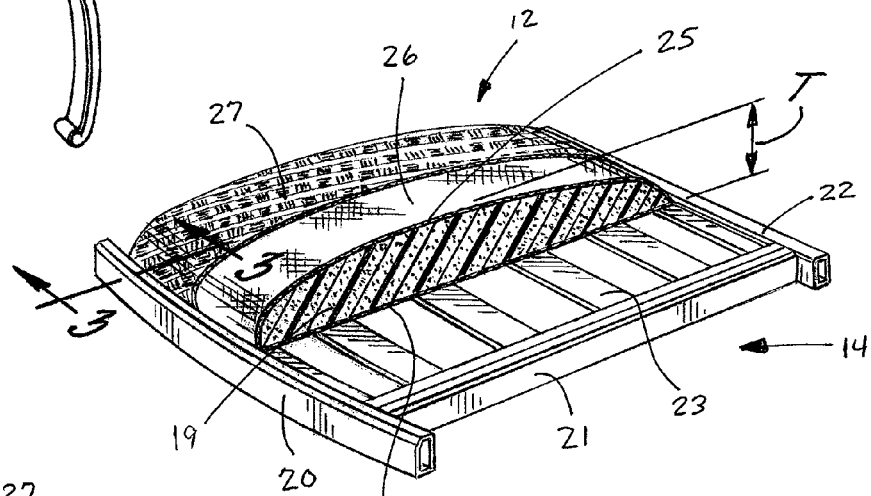
Figure 3:
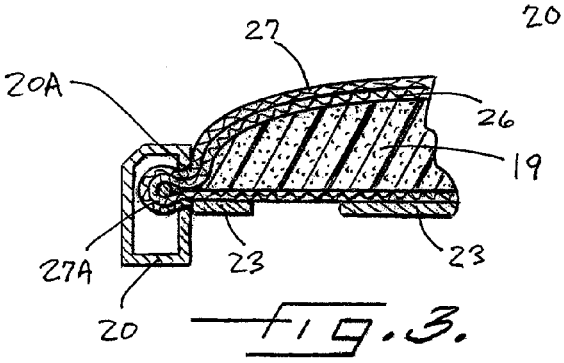

Having thus described the invention in general terms, reference will now be made to the accompanying drawings, which are not necessarily drawn to scale, and wherein:

FIG. 1 is a perspective view of a chair having a frame, a seat contact portion, and a back contact portion in accordance with one embodiment of the present invention;

FIG. 2 is a perspective section view showing a seat contact portion supported by a seat support structure and having a seat cushion, a cushion cover layer, and a rattan layer in accordance with one embodiment of the present invention; and FIG. 3 is a partial section view showing a seat support structure, a seat cushion, a cushion cover, and a rattan layer in accordance with one embodiment of the present invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

FIG. 1 shows an article of rattan furniture in the form of a chair 10 in accordance with one embodiment of the present invention. It should be noted that the present invention may be applicable to various articles of rattan furniture, including rattan chairs and couches. As shown in the drawing, the chair 10 of the depicted embodiment has the appearance and aesthetic appeal of a typical article of rattan furniture, having rattan seat and back surfaces, however as will be discussed in more detail below, in various embodiments, the chair 10 of the depicted embodiment provides a level of comfort that is not typically provided by rattan seat and back surfaces. The chair 10 of the depicted embodiment generally includes a frame 11, a seat contact portion 12, and a back contact portion 13. In the depicted embodiment, the frame 11 includes a seat support structure 14 in an approximate horizontal orientation, a back support structure 15 in a vertical or slightly reclined orientation, and four legs 16 supporting the seat support structure 14 and the back support structure 15. In the depicted embodiment, the back contact portion 13 comprises an unsupported single rattan outer layer 17 that is stretched across the back support structure 15 as is typically known in the design of rattan furniture. The depicted embodiment also includes two arms 18 attached to the seat support structure 14 and the back support structure 15, however it should be noted that other embodiments of the present invention need not include arms 18. The frame 11 of the chair 10 is constructed of a tubular metal material, however in various other embodiments, the frame 11 may constructed of any material that is known to be used for the frame of an article of furniture, including, but not limited to wood materials, plastic materials, composite materials, or combinations thereof. In the depicted embodiment, the four legs 16 comprise two front legs that extend down from the seat support structure 14 and two rear legs that are an extension of the back support structure 15, however in various other embodiments the legs 16 may be attached to the frame 11 of the chair 10 in many other ways that are sufficient to support the seat and the back support structures 14, 15.

FIGS. 2 and 3 show a seat support structure 14 and a seat contact portion 12 in accordance with one embodiment of the present invention. Unlike a typical rattan chair, in which a single layer of unsupported rattan material is stretched across support members to provide the seating area for the chair, the seat contact portion 12 of the depicted embodiment includes a seat cushion 19 that is supported by the seat support structure 14. The seat support structure 14 of the depicted embodiment includes a front cross member 20 rigidly attached to a pair of lateral cross members 21 and a rear cross member 22 also rigidly attached to the pair of lateral cross members 21. A series of support platforms 23 are rigidly attached to the lateral support members 21 to create a support surface that provides vertical support for the seat contact portion 12. The support platforms 23 are disposed between and substantially perpendicular to the lateral cross members 21. It should be noted that in the depicted embodiment, the support platforms 23 are constructed as thin strips of a metal material, however in other embodiments, the support platforms 23 may be various other shapes, may be attached to at least two of any of the cross members, and may be constructed of any other material known to be used in the design of furniture, including, but not limited to wood materials, plastic materials, composite materials, or combinations thereof.

The seat cushion 19 is supported by and located above the support platforms 23 and is structured to fit between the front 20, rear 22, and lateral cross members 21. As shown in FIG. 2, the seat cushion 19 has a relatively flat bottom surface 24 that contacts the support platforms 23 and a curved top surface 25 that defines a maximum thickness T. As shown in the figure, the overall footprint of the seat cushion 19 complements an outline defined by the interior perimeter of the front 20, rear 22, and lateral cross members 21. The seat cushion 19 of the depicted embodiment is constructed of a foam material, however in various other embodiments the seat cushion 19 may be constructed of any other material known to be used for providing support and comfort in an article of furniture. Also, in various other embodiments, the profile of the top surface 25 and/or the maximum thickness T of the seat cushion 19 may be varied in order to provide various levels of support and comfort.

As shown in FIG. 2, the seat cushion 19 is surrounded by a cushion cover layer 26. In various embodiments, the cushion cover layer 26 may be used to protect the seat cushion 19 from moisture, as would be advantageous when the chair 10 is used as outdoor furniture. It should be noted, however, that although the depicted embodiment shows a cushion cover layer 26, in other embodiments, the cushion cover layer 26 need not be included. A second rattan outer layer 27 is attached to the seat support structure on the outside (user side) of the seat cushion 19. In the depicted embodiment, the second rattan outer layer 27 is attached to the front 20, rear 22 and lateral cross members 21 such that the second rattan outer layer 27 provides a relatively smooth seating surface that conforms to the shape of the seat cushion 19 and obscures the presence of the seat cushion 19.

FIG. 3 is a partial cross section view showing the second rattan outer layer 27 attached to the front cross member 20. As shown in the figure, the cushion cover layer 26 covers the seat cushion 19, and the seat cushion 19 is supported by the support platforms 23. In the depicted embodiment, the second rattan outer layer 27 includes a curled portion 27A that is forced into a slot 20A in the front cross member 20 in order to secure the second rattan outer layer 27 to the front cross member 20. The second rattan outer layer 27 is secured to the rear 22 and lateral cross members 21 in a similar manner. Although the depicted embodiment shows the rattan outer layer 27 attached to seat support structure 14 by trapping the second rattan outer layer 27 in the front 20, rear 22, and lateral 21 cross members, in other embodiments the rattan outer layer 27 may be attached to the seat support structure 14 in various other ways as are known in the art of furniture design, such as through adhesives, fasteners, etc.

Although not shown in the Figures, it should be noted that in other embodiments, the back contact portion 13 may have a similar construction to that of the seat contact portion 12. Specifically, the first rattan outer layer 17 of the back contact portion 13 may cover a back cushion that is supported by the back support structure 15 such that the first rattan outer layer 17 conforms to the shape of the back cushion and the presence of the back cushion is obscured by the first rattan outer layer 17.

Because the seat and back contact portions include rattan outer layers, the present invention maintains the appearance and aesthetic appeal of a typical article of rattan furniture. However, because the contact portions include a cushion, the contact portions of the present invention provide a level of comfort that is not typically provided by rattan furniture articles.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An article of rattan furniture, comprising:

a frame comprising:

a seat support structure in an approximate horizontal orientation and having a front cross member, a rear cross member, a pair of lateral cross members rigidly attached to said front and rear cross members, and a support surface rigidly attached to and extending between at least two of said cross members;

a seat contact portion comprising:

a seat cushion supported by said support surface of said seat support structure and located between said front cross member, said rear cross member, and said lateral cross members;

a cushion cover layer substantially surrounding said seat cushion; and a rattan outer layer located on the outside of said seat cushion and attached to said seat support structure, wherein said rattan outer layer covers said cushion cover layer and said seat cushion such that said rattan outer layer conforms to the shape of said seat cushion and the presence of said seat cushion and said cushion cover layer is obscured by said rattan outer layer.

2. The article of rattan furniture of claim 1, further comprising:

a back support structure in a vertical or slightly reclined orientation extending adjacent said rear cross member;

four legs supporting said seat support structure and said back support structure; and a back contact portion comprising a second rattan outer layer coupled to said back support structure.

3. The article of rattan furniture of claim 2, wherein said back contact portion further comprises a back cushion supported by said back support structure, and wherein said second rattan outer layer substantially covers said back cushion such that said second rattan outer layer conforms to the shape of said back cushion and the presence of said back cushion is obscured by said second rattan outer layer.

4. The article of rattan furniture of claim 1, wherein said seat cushion is made of a foam material.

5. The article of rattan furniture of claim 1, wherein said frame is made of a metal material.

6. An article of rattan furniture, comprising:

a frame comprising:

a seat support structure in an approximate horizontal orientation and having a front cross member, a rear cross member, a pair of lateral cross members rigidly attached to said front and rear cross members, and a support surface rigidly attached to and extending between at least two of said cross members;

a seat contact portion comprising:

a seat cushion supported by said support surface of said seat support structure and located between said front cross member, said rear cross member, and said lateral cross members; and a first rattan outer layer located on the outside of said seat cushion and attached to said seat support structure;

a back support structure in a vertical or slightly reclined orientation extending adjacent said rear cross member;

four legs supporting said seat support structure and said back support structure;

a back cushion supported by the back support structure; and a cushion cover layer substantially surrounding said back cushion, wherein said first rattan outer layer substantially covers said seat cushion such that said first rattan outer layer conforms to the shape of said seat cushion and the presence of said seat cushion is obscured by said first rattan outer layer, and said second rattan outer layer substantially covers said cushion cover layer and said back cushion such that the presence of said back cushion and said cushion cover layer is obscured by said second rattan outer layer.

7. A method of constructing a rattan furniture article, the method comprising:

forming a frame element to provide structural support for the furniture article, the frame element having a seat support structure in an approximate horizontal orientation and back support structure in a vertical or slightly reclined orientation;

providing a seat cushion supported by the seat support structure;

providing a back cushion supported by the back support structure;

providing a cushion cover layer that surrounds the back cushion;

securing a first rattan outer layer to the seat support structure and on the outside the seat cushion to create a seat contact portion, wherein the first rattan outer layer conforms to the shape of the seat cushion and the presence of the seat cushion is obscured by the first rattan outer layer; and securing a second rattan outer layer to the back support structure on the outside of the back cushion and the cushion cover layer to create a back contact portion, wherein the second rattan outer layer conforms to the shape of the back cushion and the presence of the back cushion is obscured by the rattan outer layer.

8. A method of constructing a rattan furniture article, the method comprising:

forming a frame element to provide structural support for the furniture article, the frame element having a seat support structure in an approximate horizontal orientation and back support structure in a vertical or slightly reclined orientation;

providing a seat cushion supported by the seat support structure and a cushion cover layer that substantially surrounds the seat cushion; and securing a rattan outer layer to the seat support structure and on the outside the seat cushion and cushion cover layer to create a seat contact portion, wherein the rattan outer layer conforms to the shape of the seat cushion and the presence of the seat cushion is obscured by the rattan outer layer.

9. The method of constructing a rattan furniture article of claim 8, wherein said forming step further comprises providing the frame element with a back support structure in a vertical or slightly reclined orientation and four legs supporting the seat support structure and the back support structure.

10. The method of constructing a rattan furniture article of claim 8, further comprising providing a back support portion comprising a second rattan outer layer coupled to the back support structure.

11. The method of constructing a rattan furniture article of claim 8, further comprising the steps of providing a back contact portion comprising a back cushion supported by the back support structure, and securing a second rattan outer layer to the back support structure on the outside of the back cushion to create a back contact portion, wherein the second rattan outer layer conforms to the shape of the back cushion and the presence of the back cushion is obscured by the second rattan outer layer.

* * * * *